United States Patent [19]

Papistas-Scherer et al.

[11] 4,177,803

[45] Dec. 11, 1979

[54] FOOT EXERCISER

[76] Inventors: Bertha Papistas-Scherer, c/o George Spector, 3615 Woolworth Building, 233 Broadway; George Spector, 3615 Woolworth Bldg., 233 Broadway, both of New York, N.Y. 10007

[21] Appl. No.: 828,868

[22] Filed: Aug. 29, 1977

[51] Int. Cl.[2] ..... A61H 1/02

[52] U.S. Cl. ..... 128/25 B; 128/57

[58] Field of Search ..... 128/25 B, 24.3, 57, 128/58

[56] References Cited

U.S. PATENT DOCUMENTS

| | | | |
|---|---|---|---|
| 1,481,038 | 1/1924 | Stephenson | 128/25 B |
| 2,520,307 | 8/1950 | Dorrance | 128/25 B |
| 3,612,043 | 10/1971 | Inaki | 128/25 B |

FOREIGN PATENT DOCUMENTS

| | | | |
|---|---|---|---|
| 882009 | 2/1943 | France | 128/25 B |
| 353894 | 7/1931 | United Kingdom | 128/25 B |

*Primary Examiner*—Lawrence W. Trapp

[57] ABSTRACT

A device for exercising a person's foot so to improve blood circulation to the feet; the device consisting of a roller for rolling upon a floor, the roller having a toothed barrel upon which the bottom of a foot is placed, a strap fitting over the foot, so that as the roller rotates on the floor, the toothed barrel kneads the foot bottom so to circulate the blood into the region.

4 Claims, 7 Drawing Figures

13
10
11
18
15
16
14
17
19
12

15
16
14
20

17
14
15

14
12
50
41
42
11
12
18
18

50
12
51
52
53
12
56
57
6
6
54

66
52
54a
59
61
60
65
62
63
58
64
54b
62

53
55

FOOT EXERCISER

This invention relates generally to exercising devices.

It is generally well known that many persons complain of various foot troubles such as poor circulation thereto, tired feet itchiness and the like. These problems are all objectionable and are therefore in want of an improvement.

Accordingly, it is a principal object of the present invention to provide a foot exerciser that kneads the muscles of the foot underside in order to stimulate blood circulation in this area which will overcome all of the above problems so to tone up the muscles, and invigorate the flow of the blood through the foot so that fresh oxygen and body-building materials are delivered to the cells in these parts.

Another object is to provide a foot exerciser which additionally by improving the physical conditions of the feet, will improve health of the legs so to decrease varicose veins, relieve cramps and the unpleasant feeling of a leg "falling asleep" when nerves become numb.

Other objects are to provide a foot exerciser which is simple in design, inexpensive to manufacture, rugged in construction, easy to use and efficient in operation.

These and other objects will be readily evident upon a study of the following specifications and the accompanying drawing wherein.

Figure 1:
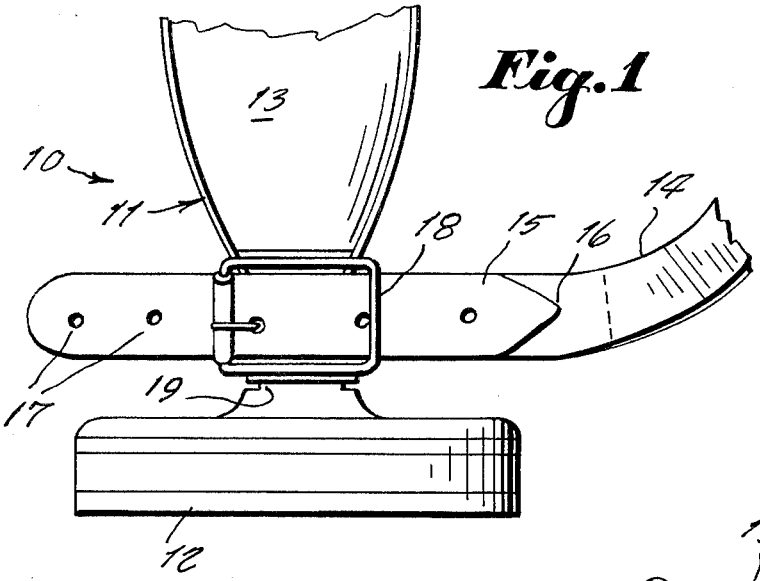
FIG. 1 is a fragmentary top view of the invention.
Figure 2:
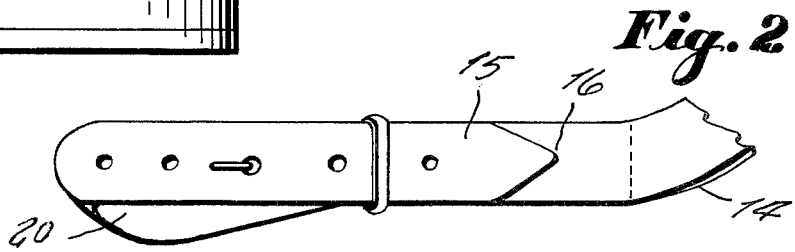
FIG. 2 is a detail view of the strap looped end that is shown in FIG. 1.
Figure 3:
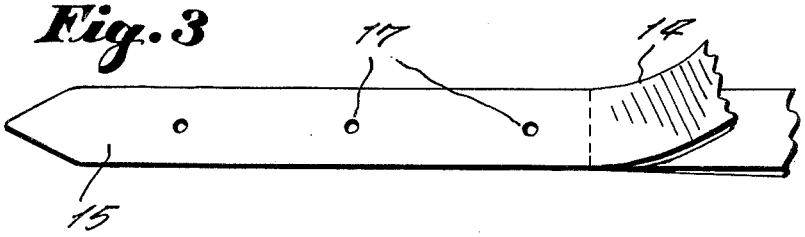
FIG. 3 is a detail view of the strap end shown unlooped.

Referring now to the drawing in detail, and more particularly to FIGS. 1 to 3 at this time, the reference numeral 10 represents a foot exerciser according to the present invention wherein there is a roller 11 made of wood or other suitable hard material, the roller including diametrically enlarged wheels 12 at each end and a convexly bulging barrel 13 therebetween; all of which are along a same central longitudinal axis. The surface of the barrel is smooth.

A strap 14 made of leather or other flexible material, each opposite end 15 of the strap being tapered to a point 16 and also having a row of spaced apart openings 17 so to relectively engage a buckle 18 after the strap is turned around a diametrically narrow portion 19 of the roller so to form a loop 20 therearound.

In operative use, a foot is placed upon the barrel which thus serves as a foot rest. The strap thus extends over a foot that is rested upon the barrel. As the roller wheels roll across a floor the foot bottom is thus massaged as it rolls upon the barrel surface.

Figure 4:
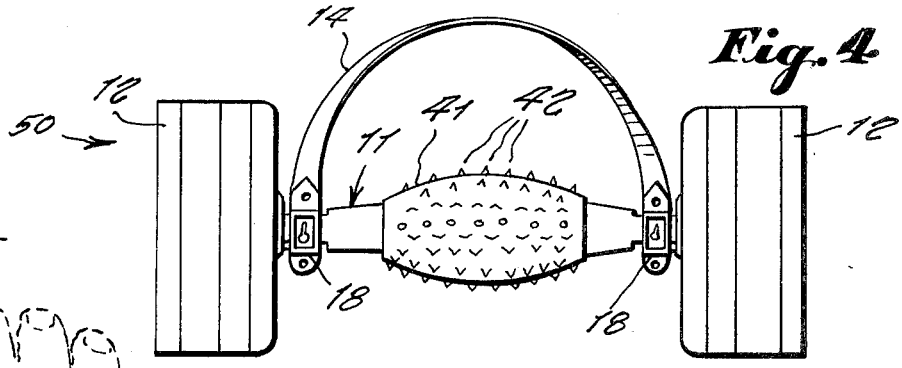
FIG. 4 is a side view of a modified design of the invention wherein the foot supporting barrel is toothed.

In FIG. 4, there is a foot exerciser 50 that is the same as foot exerciser 10 except that the barrel 41 thereof, unlike barrel 13 has a surface having projecting teeth 42 so to produce a deeper massaging action into the foot bottom.

Figure 5:
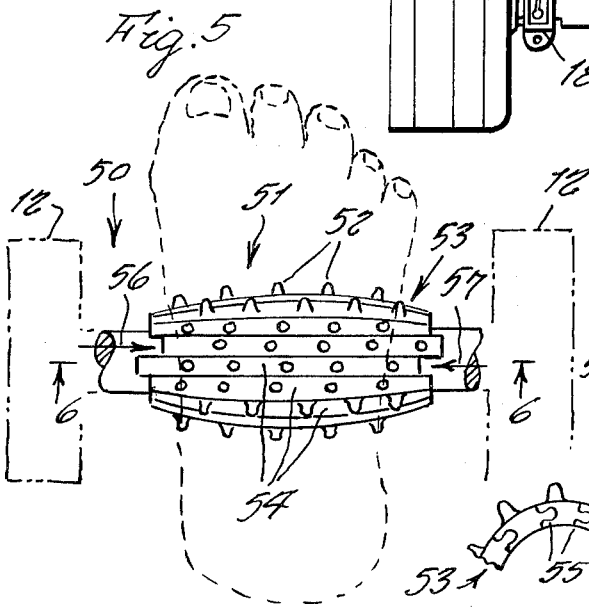
FIG. 5 is a top view of another modified design wherein the barrel additionally produces a sideward massaging action.
Figure 6:
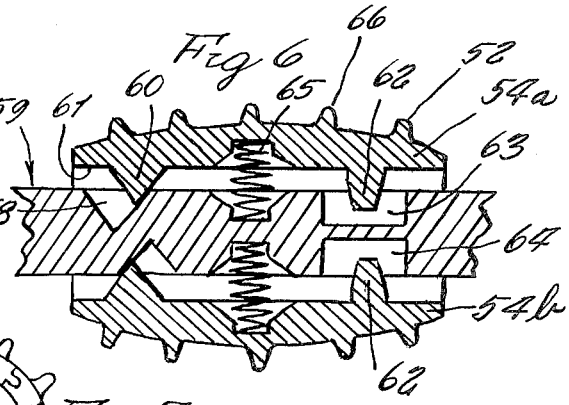
FIG. 6 is a cross sectional view taken on line 6—6 of FIG. 5 and illustrated enlarged.
Figure 7:
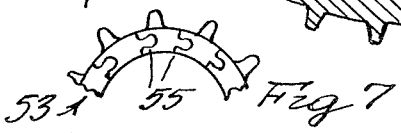
FIG. 7 is a fragmentary end view of the collar of FIGS. 5 and 6.

In FIGS. 5, 6 and 7 another modified design of foot exerciser 50 is the same as foot exerciser of FIG. 4 except that instead of the toothed barrel 41, it has a barrel 51 in which projecting teeth 52 thereof move sidewardly as a foot rests thereupon so to produce a sidewardly stretching and squeezing of the flesh on the underside of the foot thus producing a massaging effect that more closely to a hand massage for greatest beneficial effect.

In this construction, the barrel 51 is made up of a collar 53 composed of a set of axially extending strips 54 that dovetail interfit each other as shown at 55 so that any of the strips can slide independently of the others in an either endward direction, as shown by arrows 56 and 57 in FIG. 5.

This is accomplished by a V-shaped notch 58 along a central shaft portion integial with the roller 59 engaging a tapered tooth 60 on the inner side 61 of each strip. Each strip also has an inward projecting gear tooth 62 engaging a notch 63 formed between gear teeth 64 of a gear thus formed around the shaft portiom, so that in use, as a foot bears down against the barrel, the entire barrel shifts downward against the force of compression coil springs 65 one of which is between each strip and the shaft portion. Thus the axis of the barrel misaligns with the axis of the shaft portion, thus causing the tooth 60 sliding deeper into its notch 58 to slide the strip endwardly as shown by arrows, 56 and 57. As shown in FIG. 5, each alternate strip shifts into an opposite direction so that massaging teeth 52 on the outer sides of the strips thus stretch and squeeze the flesh for a greater massaging action.

This is accomplished by each adjacent V-shaped notch 58 being axially displaced relative to each other along the shaft portion, as is evident in FIG. 6 and wherein the strips **54*a*, 54*b* are shown at normal rest positions. Then the barrel is rotated so that the strip 54*b*** is depressed, the strip will slide toward a right. Thus adjacent strips sliding in opposite directions give greater massaging action.

Thus modified designs of the invention are indicated.

While various changes may be made in the detail construction, it is understood that such changes will be within the spirit and scope of the present invention as is defined by the appended claim.

What is claimed is:

1. A foot exerciser comprising in combination a roller and a strap for securing a person's foot thereupon, said roller comprising a member made of hard material, and including a wheel at each end interconnected by a portion therebetween, and said strap comprising a flexible member looped at each end around said portion and each secured therearound by a buckle.

2. The combination as set forth in claim 1 wherein said interconnecting portion includes a convex barrel.

3. The combination as set forth in claim 2 wherein said barrel includes a plurality of projecting teeth.

4. The combination as set forth in claim 1, wherein said interconnecting portion comprises a shaft integral with said wheels, a collar around said shaft being comprised of strips slidably fitted together by tongues and notches including a compression spring between each said strip and said shaft. V-shaped grooves formed around said shaft engaging a tooth formed on each of said strips, said V-shaped grooves being each misaligned axially with each said tooth so to cause said strips to slide axially when said strips are pushed toward said shaft, each strip having massaging teeth on its outer side.

* * * * *